United States Patent [19]

Suzuyama et al.

[11] Patent Number: 4,888,458

[45] Date of Patent: Dec. 19, 1989

[54] APPARATUS FOR DISCONNECTING A SWITCH OF A HIGH VOLTAGE ELECTRIC CIRCUIT

[75] Inventors: Hiroshi Suzuyama; Minoru Sakaguchi; Osamu Mikami, all of Hitachi, Japan

[73] Assignee: Hitachi, Ltd., Tokyo, Japan

[21] Appl. No.: 216,665

[22] Filed: Jul. 7, 1988

[30] Foreign Application Priority Data

Jul. 10, 1987 [JP] Japan ..... 62-170994

[51] Int. Cl.[4] ..... H01H 3/46

[52] U.S. Cl. ..... 200/400; 200/17 R

[58] Field of Search ..... 200/17 R, 400, 50 A, 200/50 AA; 335/76

[56] References Cited

U.S. PATENT DOCUMENTS 4,166,938 9/1979 Peek ..... 200/446

FOREIGN PATENT DOCUMENTS 41-4337 3/1941 Japan .
50-12677 4/1975 Japan .
55-93927 6/1980 Japan .
56-74721 6/1981 Japan .
59-9616 6/1984 Japan .
59-163719 9/1984 Japan .
60-31135 9/1985 Japan .

*Primary Examiner*—A. D. Pellinen
*Assistant Examiner*—Morris Ginsburg
*Attorney, Agent, or Firm*—Antonelli, Terry & Wands

[57] ABSTRACT

An apparatus for operating switches including a driving shaft having an operation lever portion supporting one end of a spring mechanism, with the driving shaft being separated from an operation shaft associated with a switch. A driving lever fixed to the driving shaft is connected to a main lever with a recess fixed to the operation shaft. An angle formed by central axes of these levers is set to an angle slightly exceeding 90° when a switch opening or closing operation is completed. Members for regulating the opening and closing positions of the switch are provided at positions opposed to the driving lever. By setting the angle to the above value, in a side where the angle exceeds 90°, an operating force transmitted from the driving lever to the main lever acts in a direction opposite to a direction to which the operating force acts until the angle reaches 90°, thus cancelling operating inertia energy and residual energy in the driving lever.

18 Claims, 7 Drawing Sheets

APPARATUS FOR DISCONNECTING A SWITCH OF A HIGH VOLTAGE ELECTRIC CIRCUIT

BACKGROUND OF THE INVENTION

The present invention relates to an apparatus for operating switches, and, more particularly, to a switch operating apparatus having a mechanical portion having excellent operational feature and braking feature for a switch such as a disconnecting switch or an earthing switch which can be adopted to a high voltage electric circuit.

DESCRIPTION OF THE PRIOR ART

In general, in a high voltage electric circuit, a switch such as a disconnecting switch or an earthing switch, which is used together with a breaker or is used alone, is operated or controlled to open or close contacts thereof by a switch operating apparatus using a motor or spring as an operating element.

Conventional switching apparatuses are described in, for example, Japanese patent laid-open application Nos. 56-74721 and 59-163719, wherein, as shown in FIGS. 7 and 8(*a*)–8(*d*) an outer retractor lever 7 is fixed to one end of a reversible driving shaft 6 and an operation ring 5 is fixed to the other end of the driving shaft 6, whereby the contacts of a switch 16 are open or closed, through the medium of a control lever 11 connected to the outer retractor lever 7 by rotating the driving shaft 6. Since the driving shaft 6 must be rotated quickly or promptly, the switching apparatus includes a lever portion 2 rotatably mounted on the driving shaft 6 and connected to a link which, in turn, is connected to a driving motor (not shown), and an operation lever 4 rotatably mounted on the driving shaft 6 and connected to the end of the spring mechanism 3 comprising a coil spring 3*a* and having a fixed opposite end.

A bumper lever portion 8 is fixed to the driving shaft 6 and is connected at its one end to a bumper or shock absorber 9 which abuts against a stopper 10 fixed to a case or housing (not shown) formed on the driving shaft 6 after the bumper lever portion is rotated by a predetermined angle.

In order to open or break the switch 16 on demand from the closed position shown in FIG. 7, as the link is shifted from a position shown in FIG. 8(*a*) in a direction indicated by an arrow by the operating element such as a driving motor, since a cam 2*a* formed on the lever portion 2 is coupled to a cam 4*a* formed on the operation lever portion 4, the operation lever is rotated in a counterclockwise direction thereby compressing the coil spring 3*a* of the spring mechanism 3 to accumulate energy therein. This energy accumulating cycle, during which the other cam 4*b* formed on the operation lever portion 4 is gradually separated from a cam 5*a* formed on the operation ring 5, is completed when an axis of the operation lever portion 4 is aligned with an axis of the spring mechanism 3, as shown in FIG. 8(*b*).

As shown in FIG. 8(*c*), when the operation lever portion 4 is further rotated from the position shown in FIG. 8(*b*), the energy or spring force accumulated in the spring mechanism 3 begins to be discharged. When the energy is discharged, another cam 4*b* formed on the rear of the operation lever portion 4, engages with the cam 5*a* after it has rotated through a certain angular play, thereby transmitting the energy from the spring mechanism 3 to the driving shaft 6 to rotate the latter quickly thereby opening the switch 16 through an outer retractor lever 7 and control lever 11. A condition after the energy is discharged from the spring mechanism 3 is shown in FIG. 8(*d*) and, from this condition, a next energy accumulating cycle is initiated.

In the switch operating apparatus of FIGS. 7 and 8(*a*)–8(*d*), the bumper lever portion 8, connected to the shock absorber 9 and the stopper 10, are utilized in order to absorb the residual energy in the spring mechanism 3 and/or inertia energy in the operating mechanism for opening and closing the switch thereby regulating the positions for opening and closing operations so that the driving shaft 6 and other elements are not subjected to a large impact force. More particularly, as the driving shaft 6 is rotated, the bumper lever 8 activates the shock absorber 9 to thereby engage a cam 8*a* of the bumper lever with another cam 10*a* fixed to the case (not shown) thereby requlating the operating positions.

In, for example, Japanese Utility Module publication No. 60-31135, another conventional switch operating apparatus is proposed wherein the outer retractor lever 7 is fixed to a shaft other than the driving shaft 6, a driving lever provided on the driving shaft 6 is connected to a main lever fixed to the same shaft to which the outer retractor lever 7 is fixed, with the main lever being provided with a recess in which a rotor mounted on the driving lever can slide. In this arrangement, in the positions for opening and closing the switch, an access of the main lever and that of the driving lever prevent outer forces from exerting adverse influences upon the switch.

In the above-mentioned conventional switch operating apparatuses, since there is the residual energy such as inertia energy even after the operations for opening and closing the switch have been completed, the driving force is inevitably transmitted to the various mechanism even after such operations have been completed. To avoid this, in the conventional switch operating apparatuses, the shock absorber must inevitably be utilized for restraining the impact driving force when the switch opening or closing operation is completed and, in addition, the stopper having sufficient strength must be adopted. Accordingly, the conventional switch operating apparatuses had a disadvantage that the whole apparatus is large-sized and the construction thereof is complicated.

SUMMARY OF THE INVENTION

An object of the present invention is to provide a switch operating apparatus which eliminates a shock absorber and which is simple in construction and is compact.

Another object of the present invention is to provide a switch operating apparatus in which a mechanism for accumulating energy in the spring is simplified and the whole construction is compact.

According to a switch operating apparatus of the present invention, a driving shaft having a operation lever portion which supports one end of a spring mechanism is separated from an operation shaft for a switch. A driving lever is fixed to the driving shaft and is engaged by a main lever having a recess and is fixed to the operation lever. A central axes of the driving lever and main lever form an angle slightly larger than 90 ° when the switch opening or closing operation is completed, and regulating members for regulating the switch opening and closing positions are provided in association with the driving lever.

A mechanism for driving the operation lever portion of the switch operating apparatus includes a motor and gear arrangement.

With a construction such as proposed by the present invention by selecting or setting the angle formed between the central axes of the main lever and the driving lever when the switch opening or closing operation is completed to an angle slightly larger than 90°, in the side larger than 90°, since an operating direction of an operating force transmitted from the driving lever to the main lever is reversed with respect to that in the side smaller than 90°, the driving inertia energy and the residual energy in the driving lever can be offset or can cancel each other. Further, the driving mechanism for the operation lever portion can be simplified and compact.

DESCRIPTION OF THE PREFERRED EMBODIMENTS

Figure 1:
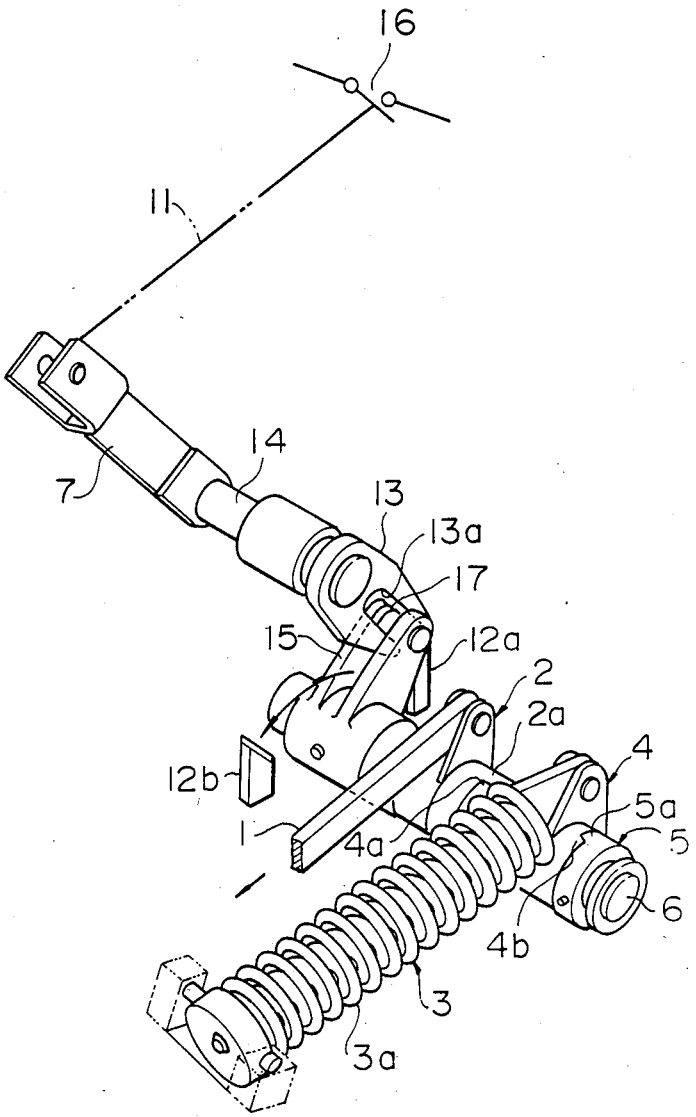
FIG. 1 is a perspective view of a switch operating apparatus according to an embodiment of the present invention.
Figure 2A:
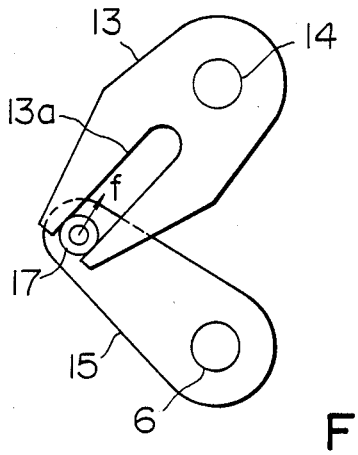
FIGS. 2(*a*) to 2(*e*) are views explaining movements of a main lever and a driving lever of the switch operating apparatus in FIG. 1.
Figure 2B:
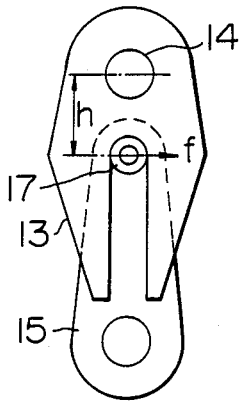
Figure 2C:
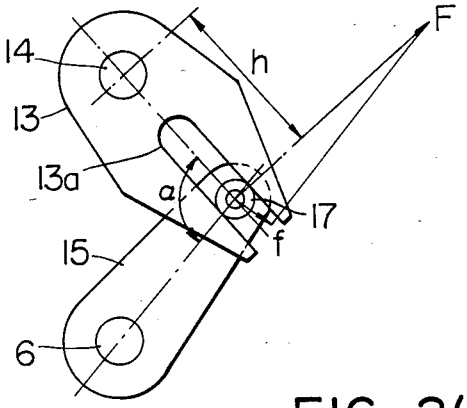
Figure 2D:
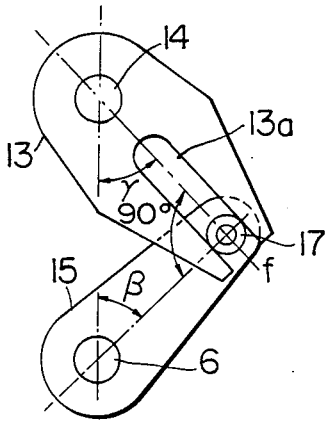
Figure 2E:
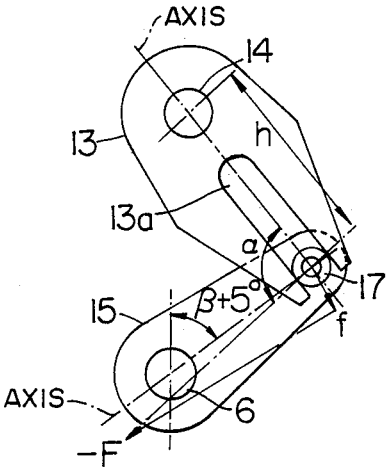

Referring now the drawings wherein like reference numerals are used throughout the various views to designate like parts and, more particularly, to FIG. 1, according to this figure, an apparatus for operating switches, that is, the switch operating apparatus having a characteristic in the point that a driving shaft 6 is separated from an operation shaft 14 for a switch, the driving shaft 6 is rotatably mounted on a case (not shown) and includes a lever portion 2 connected to a link 1 which is connected to a driving motor (not shown) as in the case of the above-described conventional switching apparatus. An operation lever portion 4 is connected to one end of a spring mechanism 3 comprising a coil spring 3*a* and acting as an operation source, and an operation ring 5. The driving shaft 6 is driven by energy accumulated in the spring mechanism 3 by the use of engagements between cams 2*a* and 4*a* and between cams 4*b* and 5*a*. The rotational force from the driving shaft 6 is transmitted to the operation lever 14 thereby activating a control lever 11 for operating the switch 16 through an outer retractor lever 7.

In FIG. 1, the driving shaft 6 is aligned with the operation shaft 14 in a vertical direction, with portions thereof partly overlapped. On one end of the driving shaft 6 a driving lever 15 is fixed in a position slightly larger than 45° from a dead point (operating point) position formed by the spring mechanism 3 and the operation lever portion 4. Consequently, an operating angular range of the driving shaft 6 is limited to from 0° to an angle slightly larger than 90°. Further, in both margins of the rotational movement of the driving shaft 6, stoppers 12*a* and 12*b* are provided. Therefore, an angle that the driving shaft 6 can rotate is $90°+\alpha$, with a value of $\alpha$ being preferably 3°–8°, and an optimum value being 5°. An abutment is provided at a free end of the driving lever. The abutment comprises a roller 17 for enabling a long-term use of the switch operating apparatus, with the roller 17 abutting against a main lever 13.

More particularly, the main lever 13 fixed to the operation shaft 14 is provided at its free end with a sliding slot or recess 13*a* into which the abutment roller 17 of the driving lever 15 is received, whereby the levers 13 and 15 are mechanically interconnected to each other. An operating force transmitted to the main lever 13 is utilized for opening and closing the switch 16 through the medium of the operation shaft 14, outer retractor lever 7 and control lever 11.

As stated above, the driving lever 15 and the main lever are so constructed that the driving lever 15 can be stopped at a position exceeding by an angle of 3°–8° from a position the axes of the levers 13, 15 form and angle of 90°. The stoppers 12*a* and 12*b* associated with the driving lever 15 determine the stop positions for the latter. FIGS. 2(*a*) to 2(*e*) show the relation of the operating force acting in various positions of the levers 13 and 15. Each of the levers 13, 15 moves from its operation starting position shown in FIG. 2(*a*) to its operation completion position shown in FIG. 2(*e*) in sequence. More specifically, energy accumulated in the spring mechanism 3 (FIG. 1) by rotating the operation lever portion 4 mounted on the driving shaft 6 is applied to the driving shaft 6 as shown in FIG. 2(*a*) only when the operation lever portion has exceeded the dead point, thereby creating a driving force f to shift the roller 17 of the driving lever 15 into the sliding recess 13*a* of the main lever 13 fixed to the operation shaft 14. Consequently, the main lever 13 is quickly rotated in a counterclockwise direction so that the main lever 13 and the driving lever 15 aligned with each other along a straight line as shown in FIG. 2(*b*). In this position, a distance h between the operation shaft 14 and the roller 17 is smallest and the driving force f is equal to the operating force F, and in this case, a operating torque, as shown in FIG. 3, is still small.

By further rotating the levers 13 and 15, when an angle $\alpha$ formed by axes of these levers is just before 90° (position shown in FIG. 2(*c*)), the driving force f of the driving lever 15 acts on the operation shaft 14 as the operating force F which is represented by the following equation:

$$F = \frac{f}{\sin(\alpha - 90°)};$$

Figure 3:
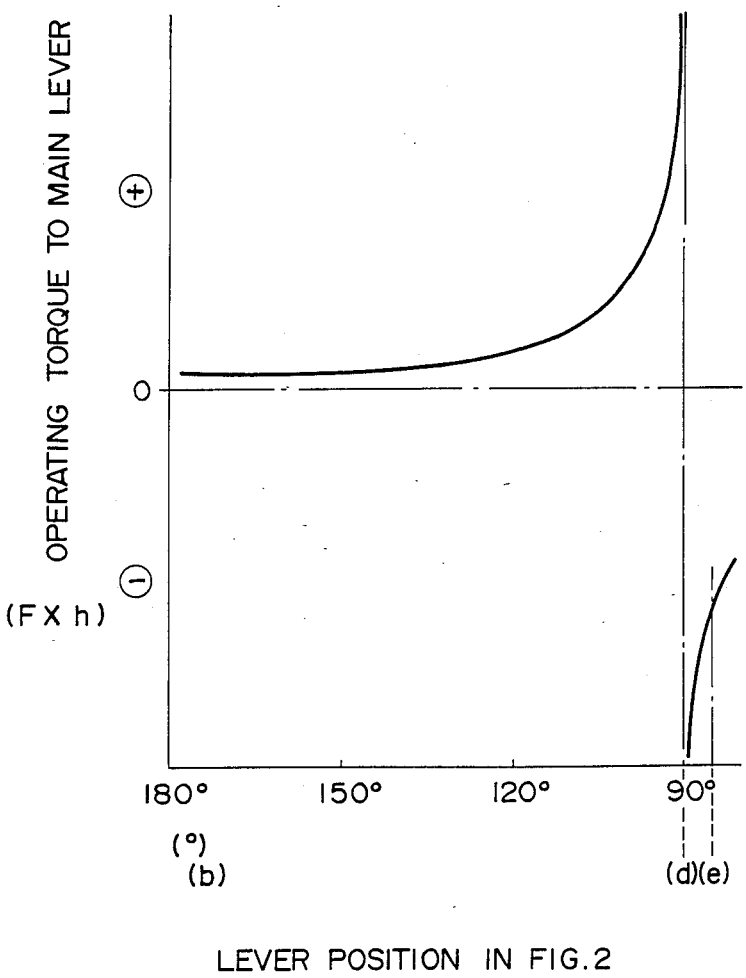
FIG. 3 is a graphical illustration of an operating torque feature in the apparatus of FIG. 1.

Thus, in a position shown in FIG. 2(*d*), where the angle $\alpha$ becomes 90°, the infinite operating force acts on the operation shaft 14, as apparent from the above equation and shown in FIG. 3. Incidentally, in FIG. 2(*d*), $\beta$ is an angle formed by the axis of the driving lever 15 and a perpendicular (vertical line) when the angle $\alpha$ is 90°, and $\gamma$ is an angle formed by the axis of the main lever 13 and the perpendicular.

Further, in a position shown in FIG. 2(*e*) which exceeds the position of FIG. 2(*d*), the operating force F can also be represented by the above equation; however, in this case, since the angle $\alpha$ is larger than 90°, in a position immediately after the position of FIG. 2(*d*) has been passed, the reversed infinite operating force shown in FIG. 3 acts on the operation shaft 14. Therefore, according to the present invention, the maximum operating force can be obtained in the later sequence where the operating force is most requested, and the residual inertia energy in the various operating mechanisms can be cancelled, since the reversed operating force is generated in the vicinity of the operation completion position.

Figure 4:
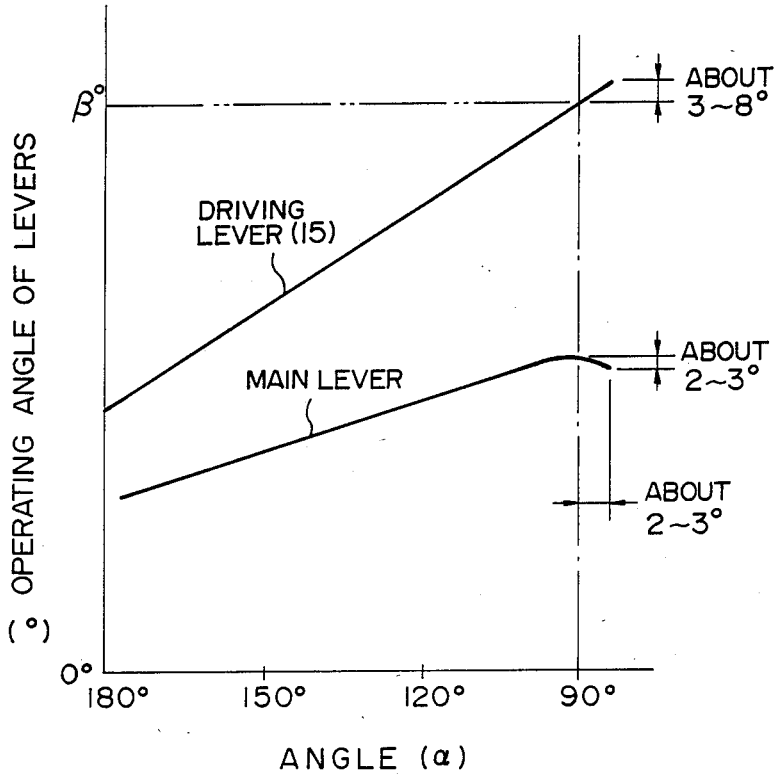
FIG. 4 is a graphical illustration of a movement feature in the apparatus of FIG. 1.

In the present invention, the stoppers 12*a* and 12*b* are provided at the positions that the rotational movement of the driving lever 15 is completed so as to permit the above-mentioned movement of the levers 13 and 15. This is because the movement features of the driving shaft 6 and the operation shaft 14 are those shown in FIG. 4. That is, the operating angles of the driving lever 15 and the main lever 13 are gradually increased; however, since the direction to which the operating force acts with respect to the operation shaft 14 is reversed when the angle formed by the axes of these levers exceeds 90°, there is no meaning in the provision of the stoppers on the operation shaft 14 for regulating the operation completion positions. In this connection, the stoppers 12*a* and 12*b* are provided for associating with the driving lever 15 of the driving shaft 6.

Further, in place of the provision of the stoppers 12*a* and 12*b*, a cam may be provided on the driving shaft 6 and a corresponding cam may be provided on a case (not shown) accommodating the switch operating apparatus in such a manner that when the cam abuts against the corresponding cam, these cams act as stoppers for regulating the operation completion positions.

Figure 5:
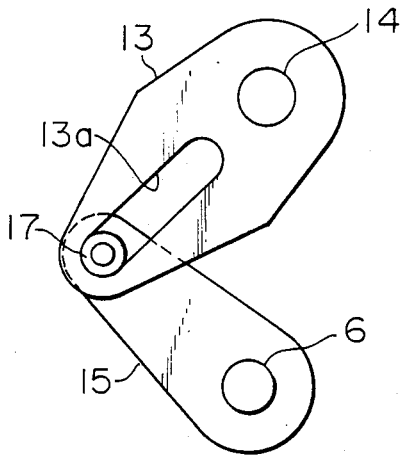
FIG. 5 is a side view of the main lever according to another embodiment of the present invention.

In place of the open recess 13*a*, the main lever 13 may be provided with a closed sliding recess 13*a* shown in FIG. 5 to mechanically incorporate the roller 17 of the driving lever 15 into the main lever, thereby improving mechanical strength of the apparatus and increasing reliability of operation of the whole switch operating apparatus.

In the embodiment of FIG. 1, although an example that the operating force for the driving shaft 6 is obtained from the operating source comprising the spring mechanism 3 connected at its one end to the operation lever portion 4 has been explained, the operating source may comprises a compressed air or the combination of motors.

Figure 6A:
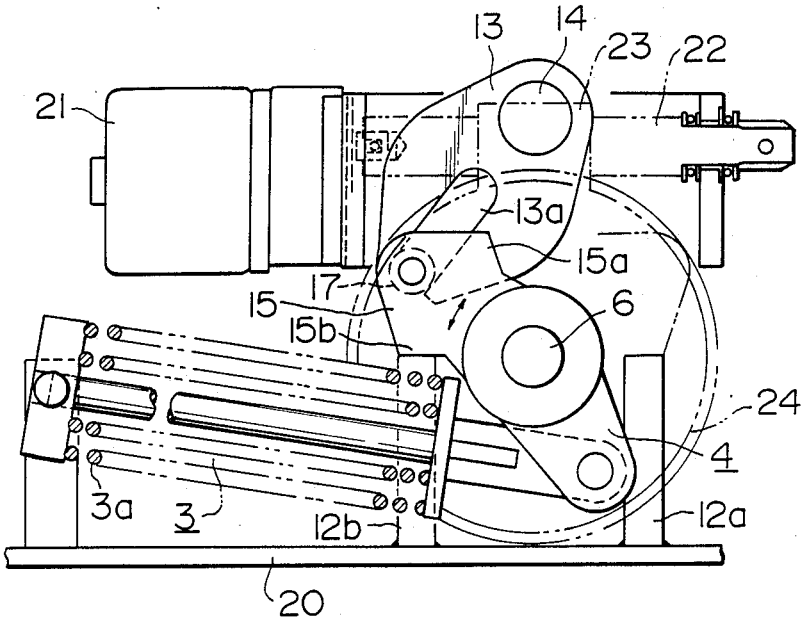
FIGS. 6(*a*) and 6(*b*) is a side view and a longitudinal sectional view, respectively, showing the switch operating apparatus according to another embodiment of the present invention.
Figure 6B:
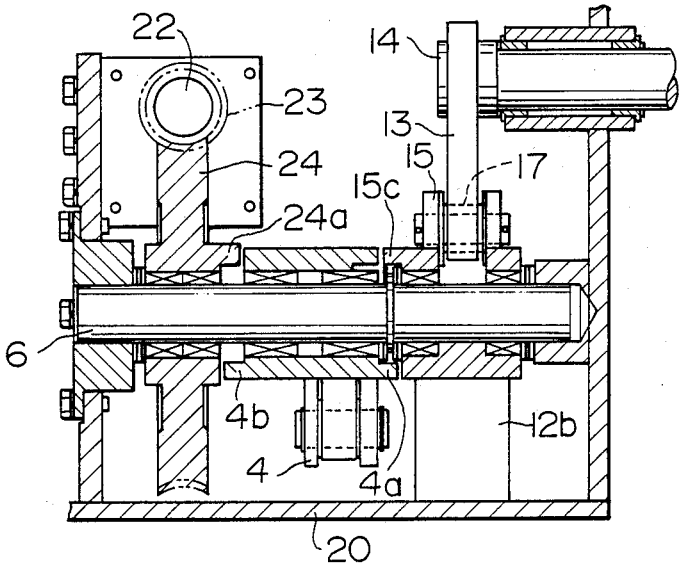
Figure 7:
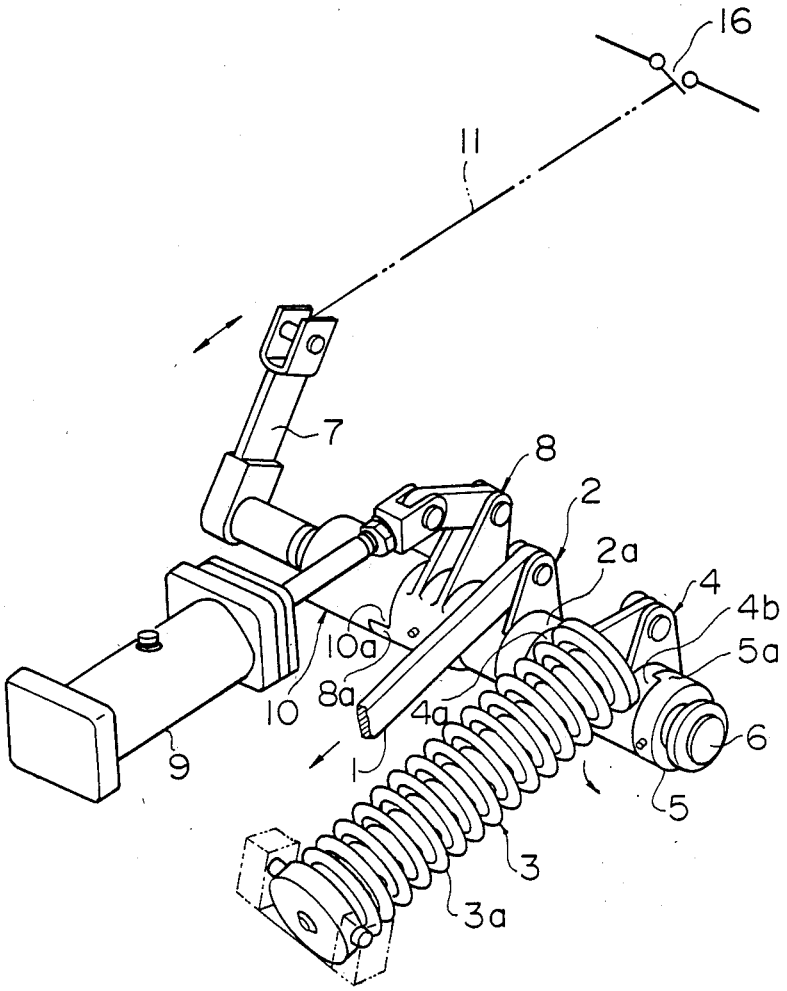
FIG. 7 PRIOR ART
FIG. 7 is a perspective view of a conventional switch operating apparatus.
Figure 8A:
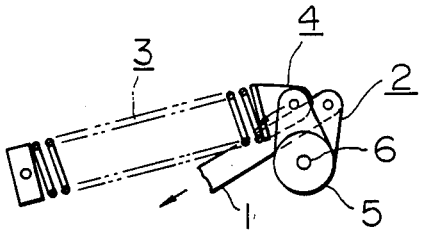
FIG. 8(a) PRIOR ART
FIGS. 8(*a*) through 8(*d*) are views explaining operation and movement of the conventional switch operating apparatus of FIG. 7.
Figure 8B:
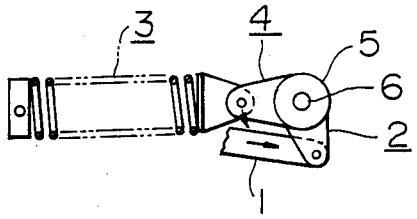
FIG. 8(b) PRIOR ART
Figure 8C:
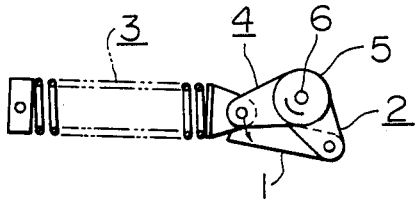
FIG. 8(c) PRIOR ART
Figure 8D:
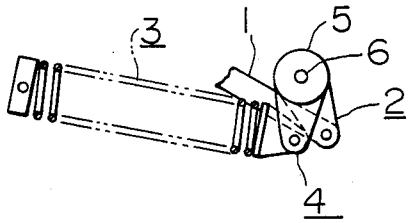
FIG. 8(d) PRIOR ART

In another embodiment of the present invention shown in FIGS. 6(*a*) and 6(*b*), an apparatus for operating switches can be made more compact by arranging the various elements on a base plate 20. More particularly, in the embodiment of FIGS. 6(*a*) and 6(*b*), a driving shaft 6 rotatably mounted on the base plate 20, an operation lever portion 4, a spring mechanism 3 constituting an operating source and having a coil spring 3*a* supported at its one end by the base plate 20 and connected at its other end to the operation lever portion 4, a main lever 13 fixed to an operation shaft 14, a sliding recess 13*a* formed in the main lever, are substantially the same as those in the previous embodiment. However, a driving lever 15 having a roller 17 as an abutment received in the sliding recess 13*a* of the main lever 13 has a specific configuration, and the lever portion is replaced by a motor 21 for rotating the operation lever portion 4 to accumulate the energy in the spring mechanism 3, thus simplifying the structure. More specifically, the driving lever 15 is designed to have projections 15*a* and 15*b* on both sides thereof as shown in FIG. 6(*a*) in consideration of the above-mentioned rotational angle of this lever. These projections 15*a* or 15*b* can abut against corresponding rod shaped stoppers 12*a* or 12*b* fixed to the base plate 20. Further, in order to rotate the operation lever portion 4 connected to the operating source or spring mechanism 3, a worm gear 24 having a large diameter (shown by a chain line) used for accumulating the energy is mounted on the driving shaft 6, and a small gear 23 (shown by a chain line) meshed with the worm gear 24 is fixed to a spindle 22 driven by the motor 21.

Therefore, by rotating the motor 21, the worm gear 24 is rotated through the small gear 23 fixed to the spindle 22, with the result of which, due to the engagement of a cam 24*a* (shown in FIG. 6(*b*)) of the worm gear 24 and a cam 4*b* of the operation lever portion, the operation lever portion 4 is rotated in a clockwise direction until it exceeds the dead point, thus accumulating the energy in the spring mechanism 3 and, at this point, the motor 21 is stopped. Upon exceeding the dead point, due to the engagement of a cam 4*a* of the operation lever portion 4 and a cam 15*c* of the driving lever 15, the operation lever portion 4 quickly rotates the driving lever 15 (the projection 15*b* of which has been abutted against the stopper 12*b*) in a clockwise direction, thus sliding the roller 17 in the sliding recess 13*a* to quickly rotate the main lever 13 and the operation shaft 14 in a counterclockwise direction, thereby rotating the outer retractor lever 7. The driving lever 15 is rotated until it slightly exceeds 90° as in the case of the previous embodiment, and thereafter, the driving lever is stopped by abutting the projection 15*a* against the corresponding stopper 12*a*.

In the switch operating apparatus having the above-mentioned construction, since all of the elements of the apparatus can be assembled on the base plate 20 which is available as a part of the case, the apparatus can be made compact and does not need a shock absorber. Moreover, the apparatus can be made lighter and more compact by utilizing the motor 21, spindle 22, small gear 23 and worm gear 24.

Further, in the above-described embodiments by setting a stroke angle from the position where the angle formed by the axes of the driving lever 15 and the main lever 13 is 90° to 3°–8°, since the angle formed by the axes of these levers 15, 13 at the operation completion position can be selected to an angle smaller than 90° by about 2°, the relationship between the levers 13 and 15 with respect to the forces from outside permits the creation of the dead point, thereby preventing adverse influences upon the inside of the switch operating apparatus. Further, since the operation completion position of the main lever 13 corresponds to an angular position smaller than the maximum stroke (angular) position by about 2°, there arises no problem regarding the operation and/or efficiency of the apparatus.

With the construction according to the present invention, since the operating force can act as a braking force at the last stage of the switching operation, the inertia energy in the mechanisms for operating the switch and the residual energy in the operating source can cancel each other, thereby eliminating the application of the shock absorber. Further, since the structure of the stoppers for regulating the operation completion positions of the driving lever can be simplified, the whole construction of the apparatus can also be simplified and, not only can the reliability of the apparatus be increased, but the maintenance and/or inspection can be facilitated.

Furthermore, by using the worm gear of a large diameter meshed with the small gear fixed to the spindle of the motor, as the mechanism for rotating the operation lever portion to accumulate the energy in the spring mechanism, the whole construction of the apparatus can be made more compact.

What is claimed is:

1. An apparatus for operating switches, the apparatus comprising a driving shaft;

an operation lever portion rotatably mounted on said driving shaft;

an operating source connected at one end to said operation lever portion and having a dead point construction in which, as said operation lever portion is rotated, energy is accumulated and then is discharged;

an outer retractor lever activated by energy accumulated in the operating source thereby operating the switches through a control lever connected to said outer retractor lever, said outer retractor lever is fixed to an operation shaft disposed substantially parallel to said driving shaft;

a main lever having a sliding recess therein fixed to said operation shaft;

an abutment provided on a driving lever fixed to said driving shaft and received in such sliding recess of said main lever; and position regulating stoppers respectively provided at operation completion positions of said driving lever, said operation completion positions corresponding to limits of rotational movement range wherein an angle subtended by axis of said main lever and said driving lever slightly exceeds 90°.

2. An apparatus for operating switches as set forth in claim 1, wherein said operating source comprises a spring mechanism having a coil spring.

3. An apparatus for operating switches as set forth in claim 1, wherein said abutment comprises a roller.

4. An apparatus for operating switches as set forth in claim 1, wherein the rotational movement range of said main lever and said driving lever exceeds 90° by between 3°–8°.

5. An apparatus for operating switches, the apparatus comprising a driving shaft;

an operation lever portion rotatably mounted on said driving shaft;

an operating source connected at one end to said operation lever portion and having a dead point construction in which, as the operation lever portion is rotated, energy is accumulated and then discharged;

an outer retractor lever activated by energy accumulated in the operating source thereby operating the switches through a control lever connected to said outer retractor lever, said outer retractor lever is fixed to an operation shaft disposed substantially in parallel to said driving shaft with portions thereof partially overlapped;

a lever portion subjected to a tension force of a link is mounted on said driving shaft adjacent to said operation lever portion, said lever portion subjected to a tension force and said operation lever portion being connected to each other by cam means, thereby accumulating the energy in said operating source;

a main lever having a sliding recess therein fixed to said operation shaft;

an abutment provided on a driving lever fixed to said driving shaft and received in said sliding recess of said main lever; and position regulating stoppers respectively provided at operation completion positions of the driving lever, said operation completion positions corresponding to limits of rotational movement range wherein an angle subtended by axis of said main lever and said driving lever slightly exceeds 90°.

6. An apparatus for operating switches as set forth in claim 5, wherein said operating source comprises a spring means having a coil spring.

7. An apparatus for operating switches as set forth in claim 5, wherein said abutment comprises a roller.

8. An apparatus for operating switches as set forth in claim 5, wherein the rotational movement range of said main lever and said driving lever exceeds 90° by between 3°–8°.

9. An apparatus for operating switches, the apparatus comprising: a driving shaft rotatably arranged on a base plate;

an operation lever portion rotatably mounted on said driving shaft;

an operating source connected at one end to said operation lever portion and having a dead point construction in which, as the operation lever portion is rotated, energy is accumulated and then is discharged;

an outer retractor lever activated by the energy accumulated in the operating source thereby operating the switches through a control lever connected to said outer retractor lever;

an operation shaft rotatably arranged along an upper axis parallel to and separated from an axis of said driving shaft;

a main lever having a sliding recess therein fixed to said operation shaft;

an abutment provided on a driving lever fixed to said driving shaft and received in said sliding recess of said main lever; and position regulating stoppers respectively fixed to said base plate at operation completion positions of the driving lever, said operation completion positions corresponding to limits of rotational movement range wherein an angle subtended by axis of said main lever and said driving lever slightly exceeds 90°.

10. An apparatus for operating switches as set forth in claim 9, wherein said operating source comprises a spring means having a coil spring.

11. An apparatus for operating switches as set forth in claim 9, wherein said abutment comprises a roller.

12. An apparatus for operating switches as set forth in claim 9, wherein the rotational movement range of said main lever and said driving lever exceeds 90° by between 3°–8°.

13. An apparatus for operating switches, the apparatus comprising:

a driving shaft rotatably arranged on a base plate;

an operation lever portion rotatably mounted on said driving shaft;

an operating source connected at one end to said operation lever portion and having a dead point construction in which, as the operation lever portion is rotated, energy is accumulated and then discharged;

an outer retractor lever activated by the energy accumulated in the operating source thereby operating the switches through a control lever connected to said outer retractor lever, said outer retractor lever is fixed to an operation shaft disposed substantially parallel to said driving shaft;

a worm gear mounted on said driving shaft and engageable with a cam, said worm gear being engageable by a small gear fixed to a spindle of a motor thereby accumulating the energy in said operating source;

a main lever having a sliding recess therein fixed to said operation shaft;

an abutment provided on a driving lever fixed to said driving shaft and received in said sliding recess of said main lever; and position regulating stoppers respectively fixed to said base plate at operation completion positions of the driving lever, said operation completion positions corresponding to limit of rotational movement range wherein an angle subtended by axis of said main lever and said driving lever slightly exceeds 90°.

14. An apparatus for operating switches as set forth in claim 13, wherein said operating source comprises a spring mechanism having a coil spring.

15. An apparatus for operating switches as set forth in claim 13, wherein said abutment comprises a roller.

16. An apparatus for operating switches as set forth in claim 13, wherein the rotational movement range of said main lever and said driving lever exceeds 90° by between 3°–8°.

17. An apparatus for operating switches, the apparatus comprising:

a driving shaft rotatably arranged on a base plate;

an operation lever portion rotatably mounted on said driving shaft;

an operating source connected at one end to said operation lever portion and having a dead point construction in which, as the operation lever portion is rotated, energy is accumulated and then discharged, said operating source including a spring mechanism having a coil spring;

an outer retractor lever activated by the energy accumulated in the operating source thereby operating the switches through a control lever connected to said outer retractor lever, said outer retractor lever is fixed to an operation shaft disposed substantially parallel to said driving shaft;

a worm gear mounted on said driving shaft and engageable with a cam, said worm gear being engageable by a small gear fixed to a spindle of a motor thereby accumulating the energy in said operating source;

a main lever having a sliding recess therein fixed to said operation shaft;

a roller constituting an abutment provided on a driving lever fixed to said driving shaft and received in such sliding recess of said main lever; and position regulating stoppers respectively fixed to said base plate at operation completion positions of the driving lever, said operation completion positions corresponding to limits of rotational movement range wherein an angle subtended by axis of said main lever and said driving lever exceeds 90° by between 3°–8°.

18. An apparatus for operating switches as set forth in claim 17, wherein said driving lever has, on both sides thereof, projections respectively corresponding to each of said stoppers.

* * * * *